US009596923B2

(12) United States Patent
Nadler et al.

(10) Patent No.: US 9,596,923 B2
(45) Date of Patent: Mar. 21, 2017

(54) MULTI-PURPOSE RECEPTACLE HAVING AN INTEGRATED INFLATABLE PILLOW THEREIN

(71) Applicant: American Recreation Products, LLC., Boulder, CO (US)

(72) Inventors: Steven Nadler, Boulder, CO (US); Scott Neilson, Boulder, CO (US); Jesse Anderson, Boulder, CO (US)

(73) Assignee: Exxel Outdoors, LLC, Boulder, CO (US)

( * ) Notice: Subject to any disclaimer, the term of this patent is extended or adjusted under 35 U.S.C. 154(b) by 131 days.

(21) Appl. No.: 14/497,912

(22) Filed: Sep. 26, 2014

(65) Prior Publication Data

US 2015/0096908 A1 Apr. 9, 2015

Related U.S. Application Data

(60) Provisional application No. 61/888,839, filed on Oct. 9, 2013.

(51) Int. Cl.

| | |
|---|---|
| ***B65D 77/00*** | (2006.01) |
| ***A45F 4/02*** | (2006.01) |
| ***A47G 9/10*** | (2006.01) |

(52) U.S. Cl.

CPC ..... *A45F 4/02* (2013.01); *A47G 9/1027* (2013.01); *A45F 2004/026* (2013.01)

(58) Field of Classification Search

USPC ..... 206/216, 522, 218, 576, 579

See application file for complete search history.

(56) References Cited

U.S. PATENT DOCUMENTS

| | | | | |
|---|---|---|---|---|
| 2,462,215 | A | 2/1949 | Norman et al. | |
| 4,277,859 | A * | 7/1981 | Seaman | A45C 9/00 383/25 |
| 4,535,878 | A * | 8/1985 | Grahl | A45C 3/10 190/1 |
| 4,712,259 | A | 12/1987 | Chiasson | |
| 4,980,935 | A | 1/1991 | Kazanowski et al. | |
| 5,119,519 | A * | 6/1992 | Foreman | A47G 9/1045 190/1 |
| 5,611,414 | A * | 3/1997 | Walker | A47C 17/82 190/2 |
| 5,815,833 | A | 10/1998 | Kuo | |
| 5,896,962 | A * | 4/1999 | Smith | A45C 3/00 190/107 |
| 6,216,297 | B1 * | 4/2001 | Lemke | A45C 9/00 5/636 |
| 6,952,845 | B1 * | 10/2005 | Akkad | A45F 4/02 383/4 |

(Continued)

FOREIGN PATENT DOCUMENTS

WO 9913749 A1 3/1999

*Primary Examiner* — Jacob K Ackun

(74) *Attorney, Agent, or Firm* — Stinson Leonard Street LLP

(57) ABSTRACT

A multi-purpose receptacle includes a bottom panel and a sidewall attached to the bottom panel. The sidewall extends from the bottom panel in a longitudinal direction. The sidewall includes a side panel and an inflatable bladder attached to the side panel. The side panel extends around at least a portion of the bottom panel. The inflatable bladder includes a sealed cavity for containing an amount of gas, and defines a portion of the sidewall.

11 Claims, 9 Drawing Sheets

(56) References Cited

U.S. PATENT DOCUMENTS

| | | | | |
|---|---|---|---|---|
| 7,604,123 | B2 | 10/2009 | Seals | |
| 2002/0088059 | A1* | 7/2002 | Reeves | A45C 7/0086 5/653 |
| 2003/0204908 | A1 | 11/2003 | Figler | |
| 2008/0264808 | A1* | 10/2008 | Gostt | A45F 4/02 206/216 |

* cited by examiner

MULTI-PURPOSE RECEPTACLE HAVING AN INTEGRATED INFLATABLE PILLOW THEREIN

CROSS-REFERENCE TO RELATED APPLICATION

This nonprovisional application claims priority to U.S. Provisional Patent Application Ser. No. 61/888,839, filed on Oct. 9, 2013, which is hereby incorporated by reference in its entirety.

FIELD

The field of this disclosure relates generally to multi-purpose receptacles, and more particularly, to multi-purpose receptacles having an integrated inflatable pillow.

BACKGROUND

Bags, sacks or other receptacles are often used by people engaging in outdoor recreational activities, such as hiking or camping, to carry personal items. Such bags may be used to transport small personal items, such as a user's keys, wallet, or cellular phone, or larger items such as a sleeping bag. Particularly for outdoor activities, it is desirable to minimize the size and weight of a person's belongings, including the size and weight of bags used to carry a person's belongings, to make travel easier.

Further, it is often desirable to carry a pillow, particularly for campers, to support one's head and/or neck while resting or sleeping. However, at least some known pillows, such as fiber-filled or down-filled pillows, are bulky and unwieldy, making storage and transport of such pillows difficult. Moreover, fiber filled or down-filled pillows are somewhat difficult to clean if they become soiled. They are also somewhat difficult to dry if they become wet.

Other known pillows may be inflated and deflated to reduce the size of the pillow while travelling. However, such pillows are typically difficult to retain beneath a user's head or neck while resting or sleeping. As a result, such pillows provide less than optimal comfort during rest or sleep. Further, such pillows are subject to being misplaced or lost because of their reduced size and weight.

Accordingly, a need exists for a receptacle that facilitates storage and transport of a pillow that provides a user with a suitable amount of comfort.

SUMMARY

In one aspect, a multi-purpose receptacle generally comprises a bottom panel and a sidewall attached to the bottom panel. The sidewall extends from the bottom panel in a longitudinal direction. The sidewall includes a side panel and an inflatable bladder attached to the side panel. The side panel extends around at least a portion of the bottom panel. The inflatable bladder includes a sealed cavity for containing an amount of gas, and defines a portion of the sidewall.

In another aspect, a multi-purpose receptacle generally comprises a bottom panel and a sidewall attached to the bottom panel. The sidewall extends in a longitudinal direction from the bottom panel, and defines an interior and an exterior of the receptacle. The sidewall includes a side panel extending around at least a portion of the bottom panel and an inflatable bladder attached to the side panel. The inflatable bladder includes an interior bladder wall exposed to the interior of the receptacle, and an exterior bladder wall exposed to the exterior of the receptacle.

In yet another aspect, a multi-purpose receptacle generally comprises a bottom panel and a sidewall attached to the bottom panel. The sidewall extends in a longitudinal direction from the bottom panel, and has interior surface and an exterior surface. The sidewall includes an inflatable bladder integrally formed within the sidewall. The inflatable bladder includes an interior bladder wall at least partially defining the interior surface of the sidewall, and an exterior bladder wall at least partially defining the exterior surface of the sidewall.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
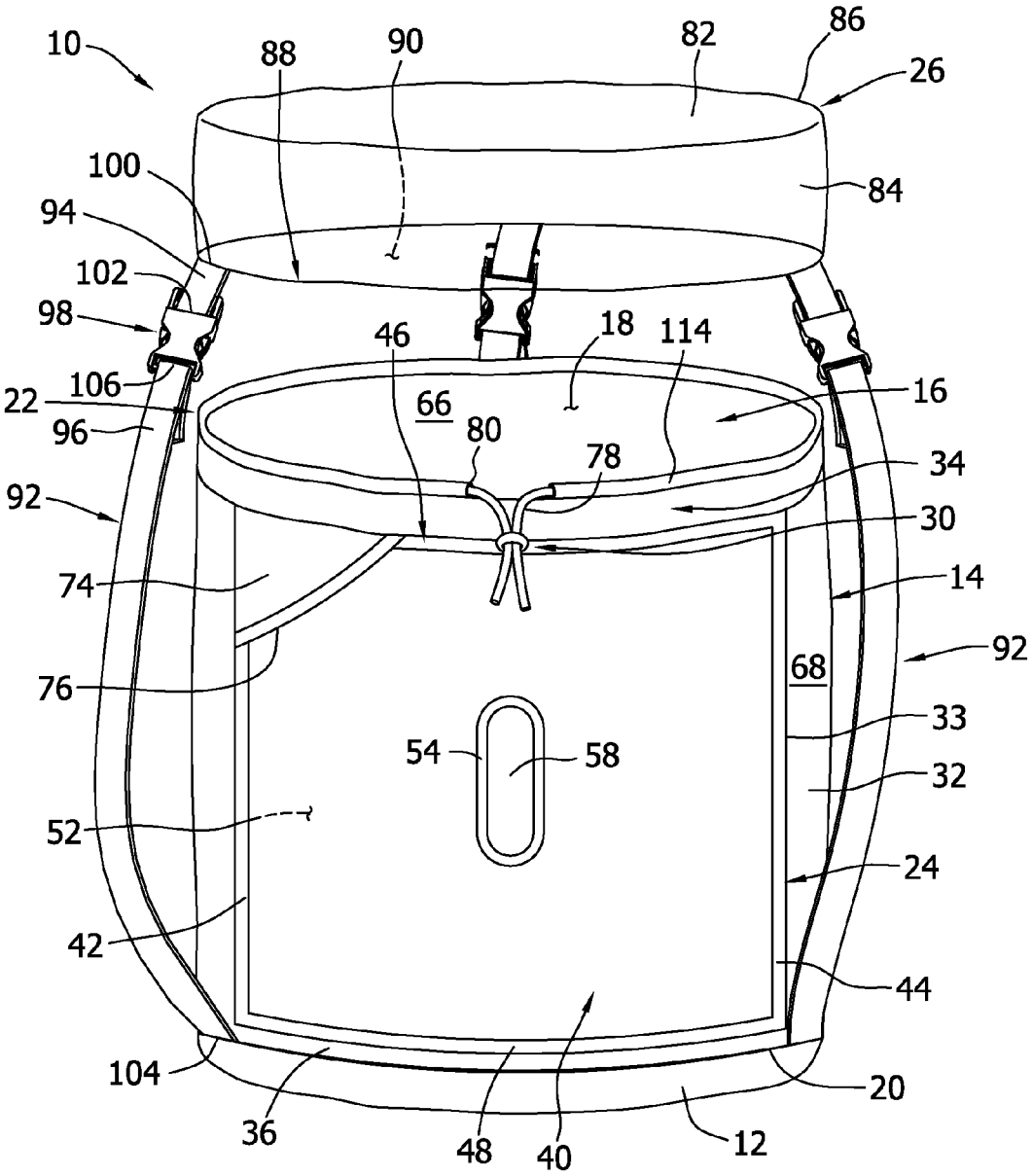
FIG. 1 is a perspective view of one suitable embodiment of a receptacle having an integrated inflatable pillow, the receptacle being in a transport configuration.
Figure 2:
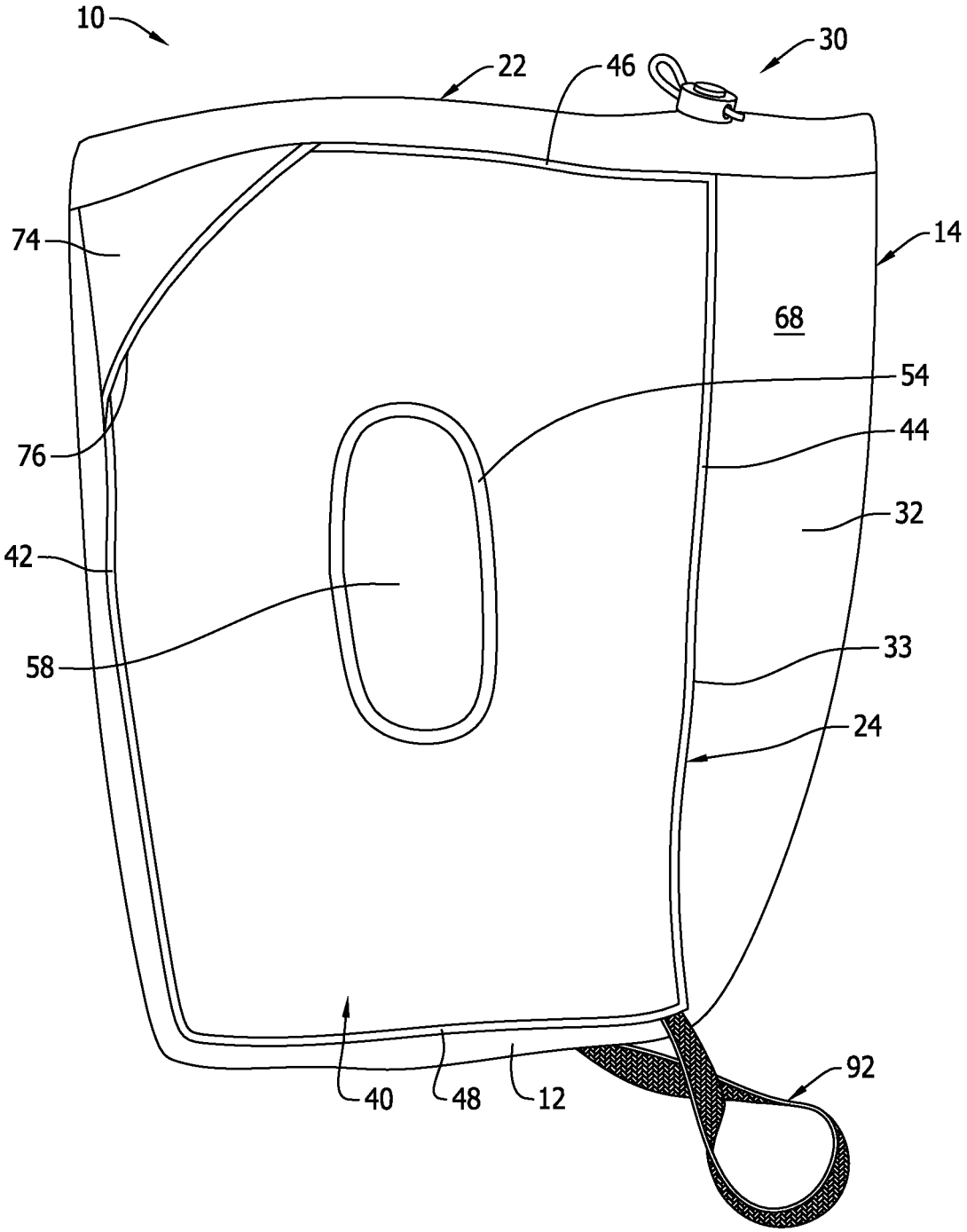
FIG. 2 is a front plan view of the receptacle of FIG. 1.
Figure 3:
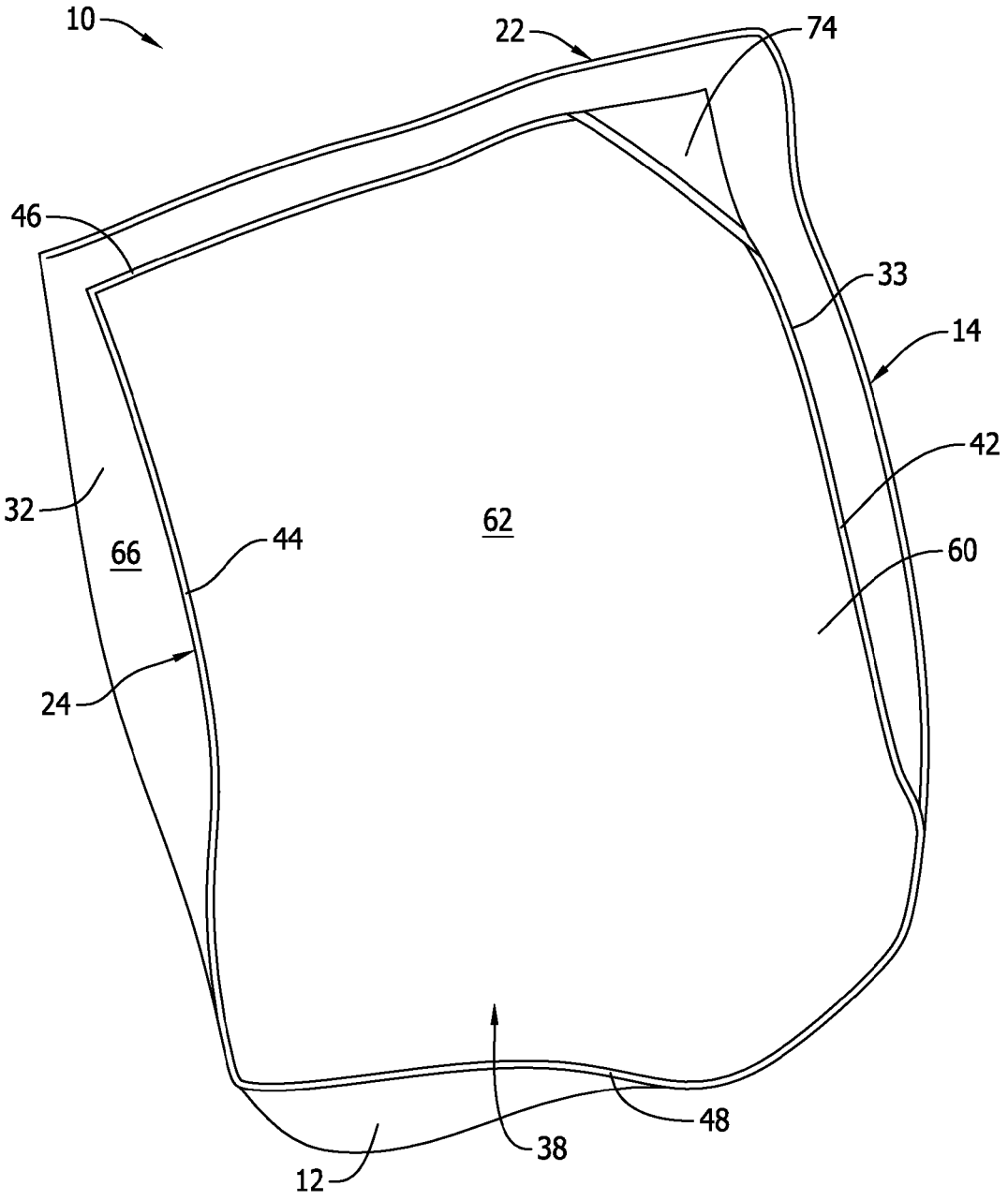
FIG. 3 is front plan view of the receptacle of FIG. 1 shown in an inverted configuration, an integrated inflatable pillow being in a deflated state.
Figure 4:
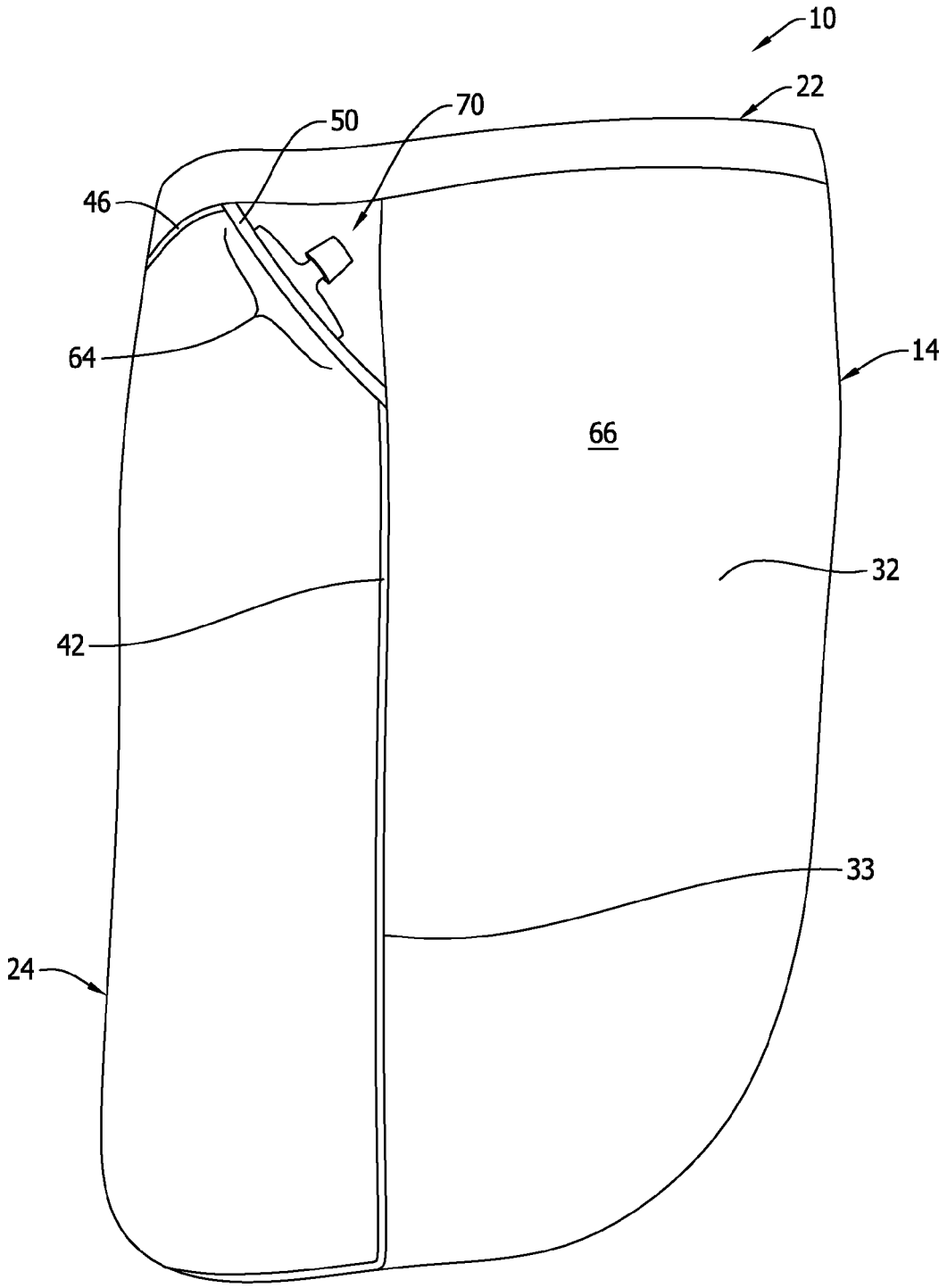
FIG. 4 is a side view of the receptacle of FIG. 1 shown in the inverted configuration.
Figure 5:
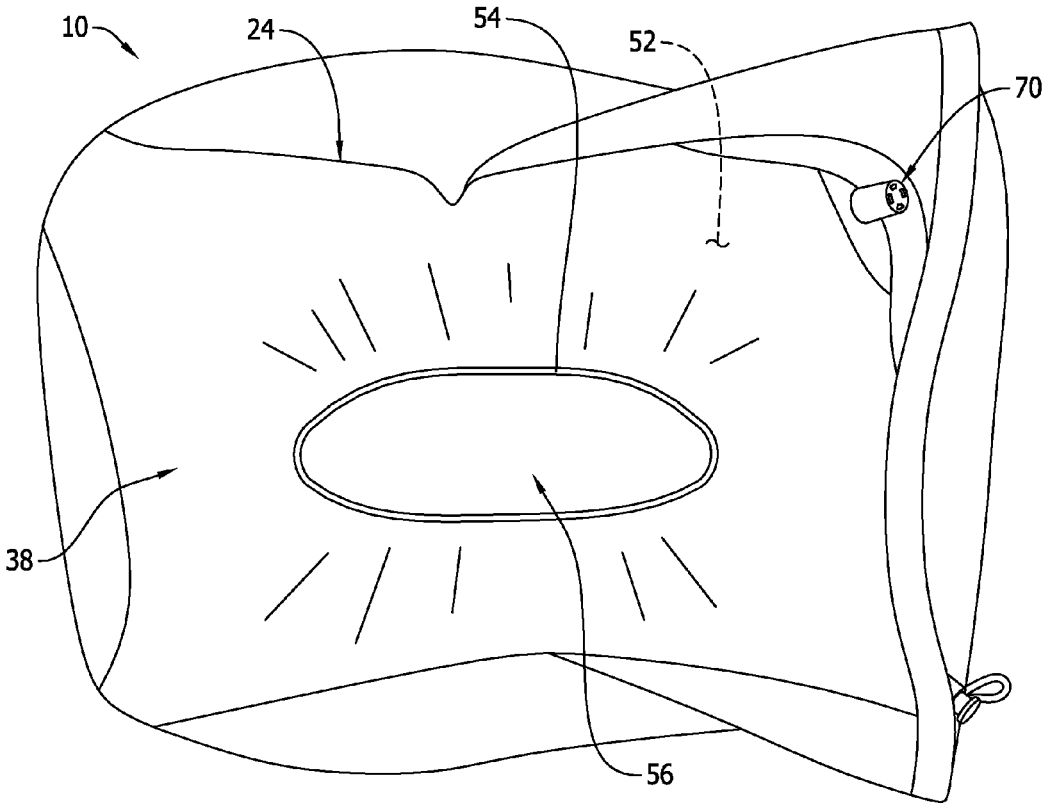
FIG. 5 is front plan view of the receptacle of FIG. 1, the integrated inflatable pillow being in an inflated state.
Figure 6:
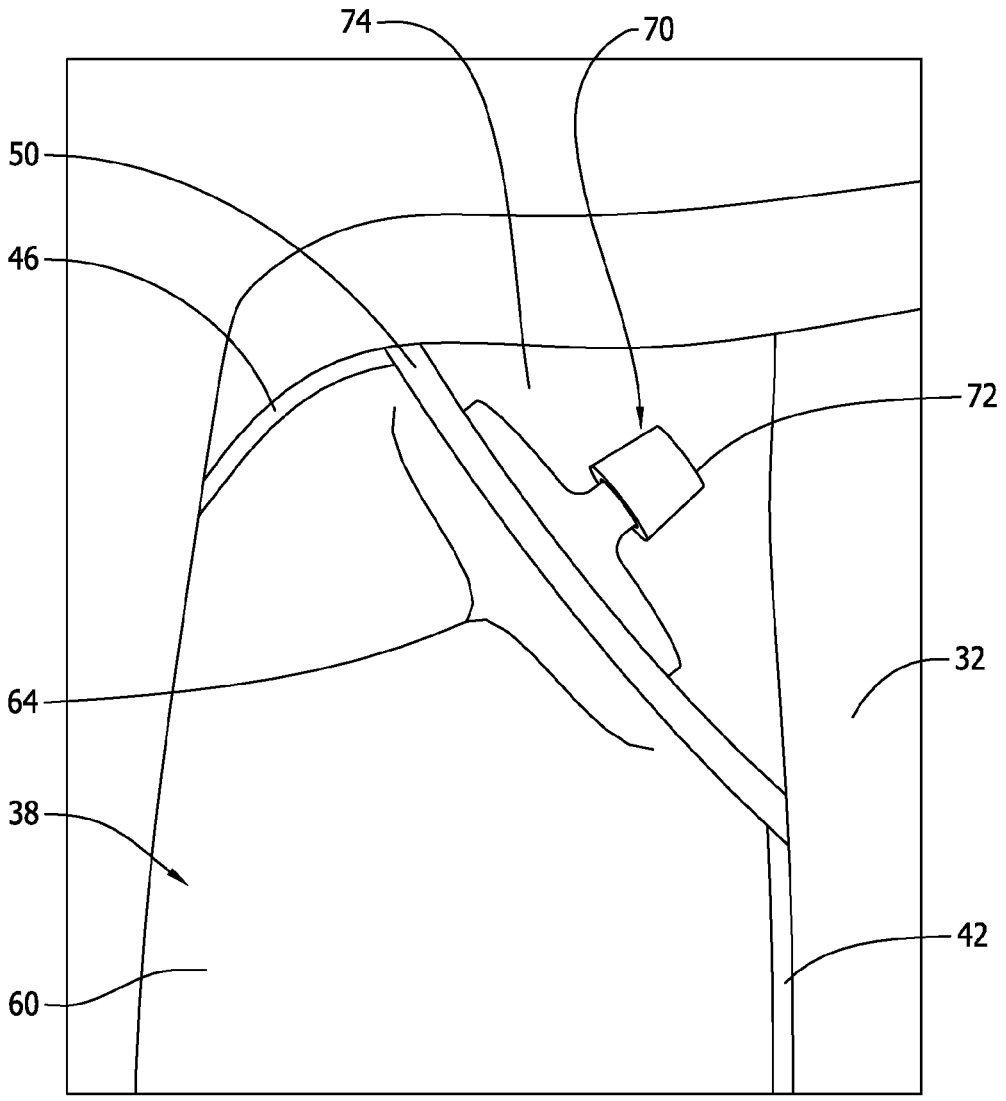
FIG. 6 is an enlarged view of a portion of the receptacle shown in FIG. 4.

Referring now to the drawings and in particular to FIGS. 1-9, one embodiment of a receptacle is designated in its entirety by the reference number 10. The illustrated receptacle 10 includes a bottom panel 12 and a sidewall, indicated generally at 14, defining an interior volume 16 and an opening 18 thereto. The sidewall 14 is connected to the bottom panel 12 along a peripheral edge 20 thereof, and extends circumferentially around the bottom panel 12. The sidewall 14 extends upward from the bottom panel 12 in a longitudinal direction to an open end 22 of the receptacle 10. The bottom panel 12 closes the end of the sidewall 14 that is opposite the open end 22.

In the illustrated embodiment, the receptacle 10 and, more specifically, the interior volume 16 are sized and shaped to receive a sleeping bag (not shown) therein. It is understood, however, that in other embodiments, the receptacle 10 and interior volume 16 may be sized and shaped to receive items other than a sleeping bag.

The receptacle 10 also includes an inflatable pillow 24 (broadly, an inflatable bladder) integrally formed within the sidewall 14 of the receptacle 10. The inflatable pillow 24 is adapted to be selectively inflated and deflated. In use, the receptacle 10 is used to carry personal items, such as a sleeping bag (not shown), while in a transport configuration (shown in FIG. 1), and is inverted (i.e., turned inside out) into a pillow configuration (shown in FIGS. 3-5) in which the inflatable pillow 24 may be inflated and used as a pillow.

The receptacle 10 also includes a cap 26 adapted to fit over and close the open end 22 of the receptacle 10 and facilitate compression of the contents within the receptacle 10, a pouch 28 (FIG. 7) adapted to receive and store the sidewall 14, the bottom panel 12, and/or the cap 26, and a closure device 30 adapted to selectively open and close the open end 22 of the receptacle 10. It is understood that the cap 26, the pouch 28, and/or the closure device 30 may be omitted in some embodiments without departing from the scope of the present disclosure.

The receptacle 10 is adapted to be selectively changed between a transport configuration (shown in FIG. 1) and a pillow configuration (shown in FIGS. 3-5) by turning the receptacle 10 inside out. Further, the receptacle 10 is adapted to be selectively changed between the transport configuration and a storage configuration (shown in FIGS. 8 and 9) by inverting the bottom panel 12 and the sidewall 14 through the pouch 28, described in more detail below.

The sidewall 14 includes a side panel 32 connected to the bottom panel 12, and the inflatable pillow 24, which is integrally formed within the sidewall 14. The side panel 32 extends around at least a portion of the bottom panel 12, such that the side panel 32 at least partially defines the interior volume 16. In the illustrated embodiment, the side panel 32 includes strips 34 and 36 extending around the top and bottom of the inflatable pillow 24. As such, in the illustrated embodiment, the side panel 32 extends around the entire peripheral edge 20 of the bottom panel 12. The side panel 32 is constructed from a liquid impermeable material, such as nylon or polyester, to protect the contents stored within the receptacle from moisture. It is understood, however, that in other embodiments, the side panel 32 may be constructed from a material other than a liquid impermeable material. The side panel 32 is attached to the bottom panel 12 by stitching, although it is understood that the side panel 32 may be attached to the bottom panel 12 by any suitable means that enable the receptacle 10 to function as described herein.

The inflatable pillow 24 includes a first, or interior bladder wall 38 (shown in FIG. 3), and a second, or exterior bladder wall 40. The interior bladder wall 38 and the exterior bladder wall 40 are sealed together along a first side seam 42, a second side seam 44 opposite the first side seam 42, and first and second end seams 46 and 48 extending perpendicularly between the first side seam 42 and the second side seam 44. In the illustrated embodiment, the interior bladder wall 38 and the exterior bladder wall 40 are also sealed together along a corner seam 50 (shown in FIG. 4) extending from the first side seam 42 at an oblique angle to the first end seam 46. Together, the interior bladder wall 38 and the exterior bladder wall 40 define a sealed cavity 52 adapted to receive and contain a desired amount of gas (e.g., a user's breath) therein.

The interior bladder wall 38 and the exterior bladder wall 40 are also sealed together along a central seam 54 located within a central region of the inflatable pillow 24. The central seam 54 is adapted to provide a depressed region 56 (FIG. 5) within the inflatable pillow 24 when the inflatable pillow 24 is inflated (shown in FIG. 5). In the illustrated embodiment, the central seam 54 has a generally rounded shape, and more specifically, an oblong circular shape. It is understood that the central seam 54 may have a shape other than an oblong circular shape without departing from the scope of the present disclosure. The central seam 54 defines an inner region 58 which, in the illustrated embodiment, is in fluid communication with the cavity 52 such that the inner region 58 may be inflated when the inflatable pillow 24 is inflated. In alternative embodiments, the inner region 58 may be completely sealed from the cavity 52 such that the inner region 58 is not inflated when the inflatable pillow 24 is inflated to provide a more exaggerated depressed region.

The interior bladder wall 38 and the exterior bladder wall 40 may be constructed of gas impermeable plastic films including, but not limited to, polyvinyl chloride and polyurethane. In the illustrated embodiment, the interior bladder wall 38 includes a liner 60 (shown in FIG. 3) thereon adapted to provide a more comfortable surface for a user as compared to the interior bladder wall 38. The liner 60 may be constructed of any suitably soft and/or comforting material including, but not limited to, fleece and woven cloth, such as polyester pongee. The liner 60 spans substantially the entire interior bladder wall 38 and defines an interior surface 62 of the inflatable pillow 24. In the illustrated embodiment, the liner 60 is stitched to the seams 42, 44, 46, 48, 50 of the interior bladder wall 38. In other embodiments, the liner 60 may be detachably attached to the interior bladder wall 38 using, for example, snaps, buttons, hook-and-loop fasteners, and magnets, such that the liner 60 may be removed from the receptacle 10.

In the illustrated embodiment, the inflatable pillow 24 is irremovably incorporated within the sidewall 14. That is, the inflatable pillow 24 cannot be removed from the sidewall 14 without damaging, destroying, or rendering the receptacle 10 unusable for its intended purpose. Specifically, in the illustrated embodiment, the inflatable pillow 24 is attached to the side panel 32 by stitching along the first side seam 42, the second side seam 44, the first end seam 46, and the second end seam 48. In some embodiments, the inflatable pillow 24 may be attached to the side panel 32 by means other than stitching including, but not limited to, heat sealing. In yet other embodiments, the inflatable pillow 24 may be removably incorporated within the sidewall 14 using, for example, snaps, buttons, hook-and-loop fasteners, and magnets. That is, the inflatable pillow 24 may be removed from the sidewall without damaging, destroying, or rendering the receptacle 10 unusable for its intended purpose.

In the illustrated embodiment, a portion 64 (shown in FIGS. 4 and 6) of the corner seam 50 is provided for attachment to a valve 70 (described below). In the illustrated embodiment, the portion 64 of the corner seam 50 is not attached to the side panel 32 or any other portion of the sidewall 14 such that the corner seam 50 is accessible from the interior and the exterior of the receptacle 10. As such, the corner seam 50 is referred to herein as a "free" edge or seam of the inflatable pillow 24. Alternatively, the corner seam 50 may be attached to the side panel 32 along substantially the entire length of the corner seam 50 such that the corner seam 50 is only accessible from the interior or the exterior of the receptacle 10.

As described above, in the illustrated embodiment, the side panel 32 extends around the entire peripheral edge 20 of the bottom panel 12. As such, the side seams 42, 44 and the end seams 46, 48 of the inflatable pillow 24 are attached to the side panel 32. It is understood, however, that the inflatable pillow 24 may be attached to the bottom panel 12 along one or more seams 42, 44, 46, 48 of the inflatable pillow 24.

The inflatable pillow 24 defines a portion of the sidewall 14. More specifically, the inflatable pillow defines the portion of the sidewall 14 not defined by the side panel 32. More specifically, the interior bladder wall 38 partially defines an interior surface 66 of the sidewall 14, and the exterior bladder wall 40 partially defines an exterior surface 68 of the sidewall 14. As such, the interior bladder wall 38 is exposed to the interior volume 16 and the exterior bladder wall 40 is exposed to the exterior of the receptacle 10 when the receptacle is in the transport configuration (shown in FIG. 1). In other words, the side panel 32 defines an opening 33 about which the inflatable pillow 24 is connected to the side panel 32, and the inflatable pillow 24 substantially covers the opening 33 defined by the side panel 32.

The inflatable pillow 24 also includes a valve 70 (shown in FIGS. 4 and 6) adapted to provide selective fluid communication with the sealed cavity 52 of the inflatable pillow 24 such that the inflatable pillow 24 may be inflated (shown in FIG. 5) and deflated (shown in FIGS. 1-4). The valve 70 may have any suitable configuration or construction that enables selective fluid communication with the sealed cavity 52 of the inflatable pillow 24. In the illustrated embodiment, the valve 70 is a screw type valve configured to be opened and closed upon rotation of a valve cover 72.

The valve 70 is attached to the inflatable pillow 24 along the portion 64 of the corner seam 50 that is not attached to the side panel 32. That is, the valve 70 is attached to the free portion 64 of the corner seam 50. As a result, the valve 70 is accessible from the interior of the receptacle 10 and the exterior of the receptacle 10 when the receptacle 10 is in either the transport configuration (shown in FIGS. 1-2) or the pillow configuration (shown in FIGS. 3-4). As such, the construction and configuration of the inflatable pillow 24 and the valve 70 facilitate easy inflation and deflation of the inflatable pillow 24. In embodiments where the corner seam 50 is attached to the side panel 32 along substantially the entire length of the corner seam 50, the valve 70 may only be accessible from the interior or the exterior of the receptacle 10. Further, it is understood that the valve 70 may be attached to the inflatable pillow 24 at a location other than the free portion 64 of the corner seam 50 without departing from the scope of the present disclosure.

The sidewall 14 also includes a triangular flap 74 attached to the side panel 32 proximate the first side seam 42 and the first end seam 46. The flap 74 includes a free edge 76 extending at an oblique angle across the inflatable pillow 24 from the first side seam 42 to the first end seam 46. The flap 74 is thereby adapted to selectively cover the valve 70 by manually manipulating the flap 74 and/or the valve 70 such that the valve 70 is located inwardly with respect to the flap 74. The flap 74 is thereby adapted to protect the valve 70 from damage and environmental conditions, such as moisture. Alternatively, the flap 74 does not include a free edge 76, and is attached to the side panel 32 and/or the corner seam 50 along substantially the entire length of the edge 76.

Referring again to FIG. 1, the closure device 30 is adapted to at least partially close the open end 22 of the receptacle 10 to secure items contained therein. In the illustrated embodiment, the closure device 30 includes a pull cord 78 extending through an eyelet 80 and a passage 114 defined proximate the open end 22 of the receptacle 10. The passage 114 may be formed, for example, by folding over a portion of the side panel 32 and stitching the folded over portion and the side panel 32 together around the circumference of the side panel 32. It is understood that closure devices other than a pull cord may be utilized to selectively open and close the open end 22 of the receptacle 10. Further, in some embodiments, the eyelet 80 may be omitted.

The cap 26 is adapted to fit over the open end 22 of the receptacle 10, and further secure items contained therein. Specifically, the cap 26 includes a top panel 82 and a side panel 84 attached to a peripheral edge 86 thereof. The side panel 84 extends around the peripheral edge 86 of the top panel 82, and defines an open end 88 of the cap 26. The open end 88 of the cap 26 has an opening 90 sized and shaped to receive the open end 22 of the receptacle 10 therein.

Moreover, the cap 26 is adapted to facilitate compression of contents contained within the receptacle 10. Specifically, the cap 26 is detachably attached to the receptacle 10 by a plurality of compression straps 92 adapted to compress contents contained within the receptacle. Each compression strap 92 includes a first strap 94, a second strap 96 and a fastener 98. The first strap 94 is attached to the cap 26 at one end 100 of the first strap 94 and to the fastener 98 at the other end 102 of the first strap 94. The second strap 96 is attached to one of the side panel 32 and the bottom panel 12 at a first end 104 of the second strap 96 and to the fastener 98 at a second end 106 of the second strap 96. The second strap 96 is adjustably attached to the fastener 98 such that a length of the second strap 96 between the first and second ends 104, 106 of the second strap 96 may be selectively adjusted to pull the cap 26 tightly over the open end 22 of the receptacle 10, and compress contents contained therein. It is understood that, alternatively or additionally, the first strap 94 may be adjustably attached to the fastener 98 such that the first strap may be adapted to pull the cap 26 tightly over the open end 22 of the receptacle 10, and compress contents contained therein.

In the illustrated embodiment, fasteners 98 are side-release buckles, although it is understood that any detachable fastener may be utilized as fasteners 98, including, but not limited to, snaps, buttons, hook-and-loop fasteners, and magnets. Further, the illustrated embodiment includes three compression straps 92, although it is contemplated that the receptacle 10 may include more or less than three compression straps.

In alternative embodiments, the cap 26 may be non-detachably attached to the receptacle 10 by the compression straps 92. In such embodiments, the fasteners 98 may be replaced with non-detachable adjusters, including, but not limited to, ladder locks. In yet further alternative embodiments, the cap 26 may be omitted from the receptacle 10. In such embodiments, the ends 100 of the compression straps 92 may be attached to the receptacle 10 proximate the open end 22 of the receptacle (i.e., opposite ends 104).

Figure 7:
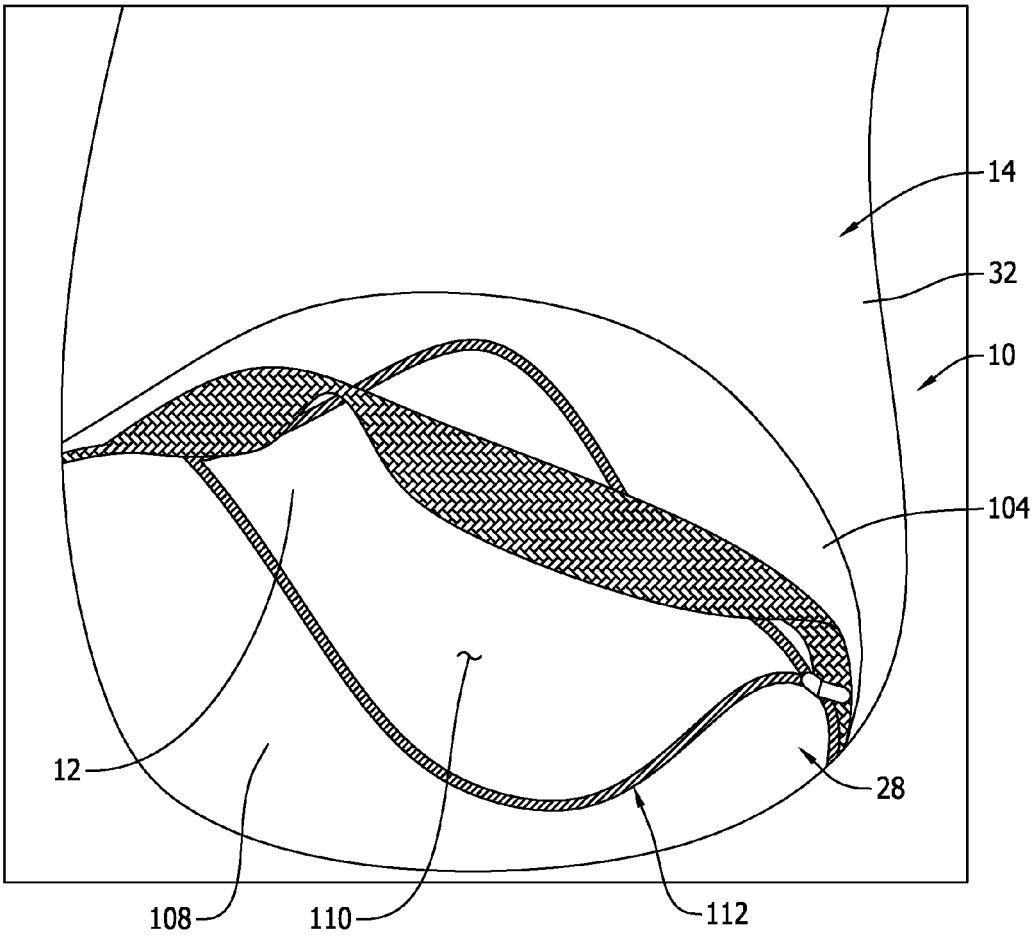
FIG. 7 is a bottom perspective of the receptacle of FIG. 1.
Figure 8:
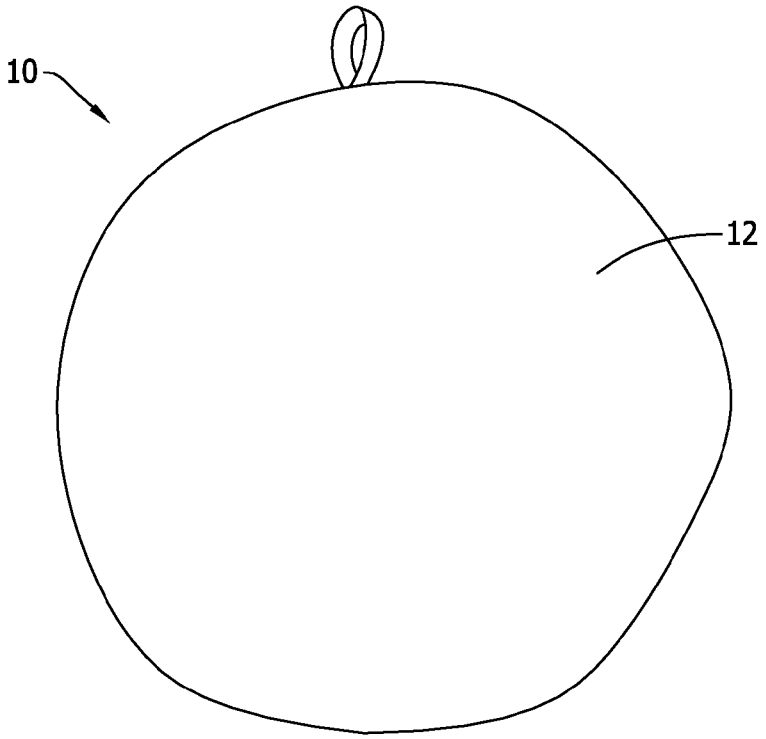
FIG. 8 is a bottom plan view of the receptacle of FIG. 1 in a storage configuration.
Figure 9:
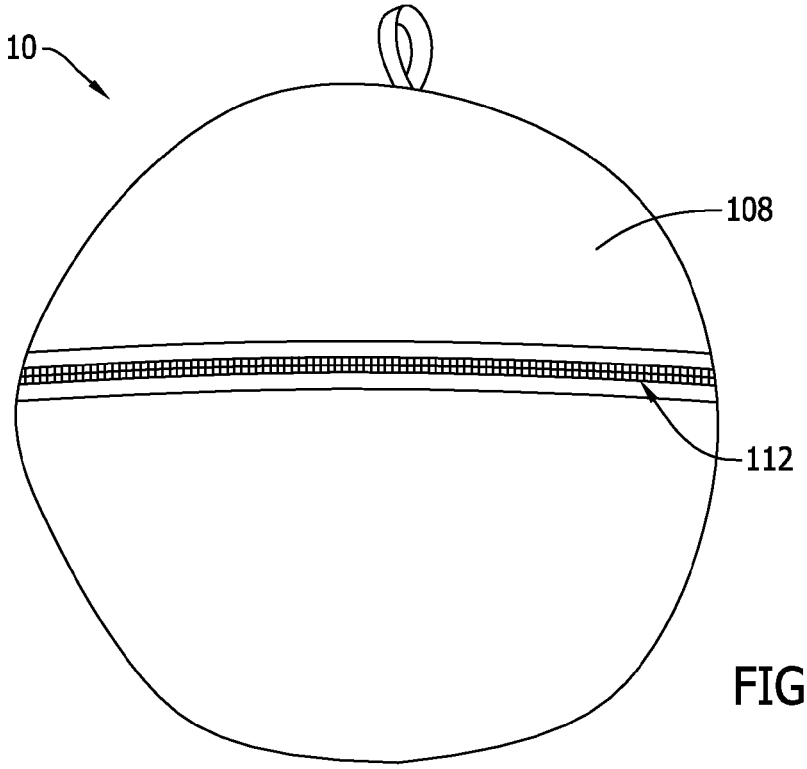
FIG. 9 is a top plan view of the receptacle of FIG. 1 in a storage configuration.

Referring to FIG. 7, the pouch 28 is configured to receive and store the sidewall 14, the bottom panel 12, and/or the cap 26 therein by inverting the receptacle 10 from the transport configuration (shown in FIG. 1) to the storage configuration (shown in FIGS. 8 and 9). Specifically, the pouch 28 includes a pouch panel 108 extending outwardly from an exterior surface of the bottom panel 12. The pouch panel 108 includes an opening 110 defined therein. The opening 110 is sized and shaped such that the sidewall 14 and bottom panel 12 may be inverted therethrough. The pouch 28 further includes a pouch closure device 112 attached to the pouch panel 108 proximate the pouch opening 110, and adapted to selectively open and close the pouch opening 110. In the illustrated embodiment, the pouch closure device 112 is a zipper, although it is understood that the pouch closure device 112 may be any suitable closure device that enables the pouch opening 110 to be selectively opened and closed.

Figure 10:
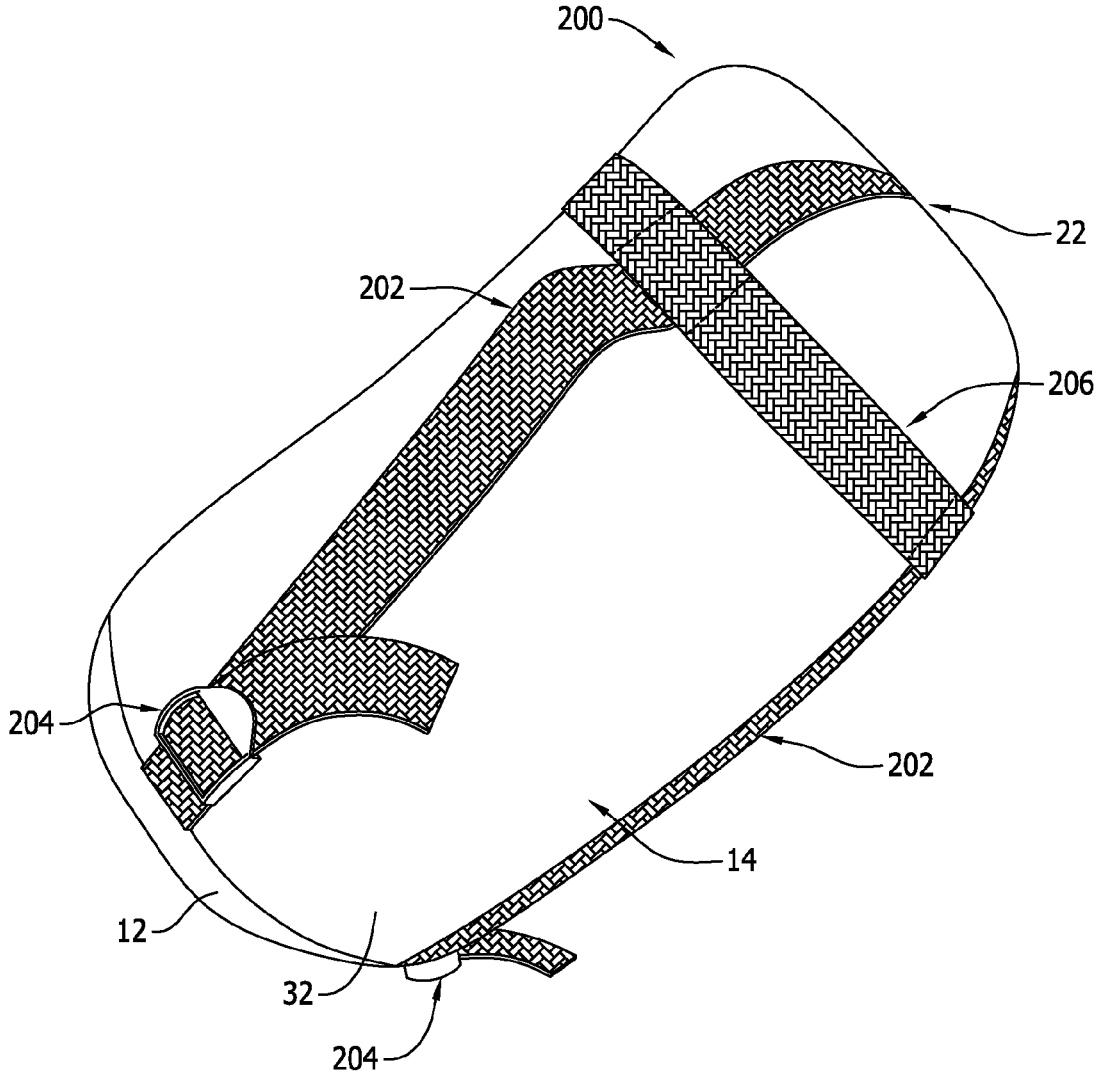
FIG. 10 is a perspective view of another embodiment of a receptacle.

FIG. 10 is a perspective view of an alternative receptacle, indicated generally at 200. The receptacle 200 includes alternative compression straps 202 having an alternative configuration suitable for use with the receptacle 10 shown in FIGS. 1-9, particularly where the receptacle 10 does not include a cap 26. More specifically, the receptacle 200 does not include a cap 26 (shown in FIG. 1), and the compression straps 202 of the receptacle 200 are attached to opposite sides of the receptacle 200, and extend over the open end 22 of the receptacle 200. Each compression strap 202 includes an adjuster 204 adapted to selectively adjust a length of the compression strap 202 such that the compression strap 202 may be pulled tight over the open end 22 of the receptacle 200, and compress the contents contained therein. In the illustrated embodiment, the adjusters 204 are ladder locks, although any suitable adjuster may be used that enables the receptacle to function as described herein. The receptacle 200 also includes a retainer strap 206 adapted to maintain the position of compression straps 202 on the side panel 32. Specifically, the retainer strap 206 extends around the perimeter of the side panel 32, and is stitched to the side panel 32 on opposing sides of each compression strap 202 to prevent the compression straps 202 from sliding off the open end 22 of the receptacle 200.

An advantage of the above embodiments is that the receptacle provides an integrally formed inflatable pillow which does not require or occupy additional storage space within the receptacle. An additional advantage of the inflatable pillow being integrally formed with the receptacle is that the effective weight of the pillow is increased by the weight of the receptacle, thereby reducing the likelihood that the pillow is displaced or dislodged from beneath a user's head or neck while the user is resting or sleeping. A yet further additional advantage of the inflatable pillow being integrally formed with the receptacle is that the inflatable pillow is less likely to be misplaced or lost because it is integrally formed with the receptacle. An additional advantage of the embodiments described herein is that the receptacles enable a user to access an inflation valve on the inflatable pillow from the interior or the exterior of the receptacle when the receptacle is in a transport configuration or a pillow configuration. As a result, the embodiments described herein facilitate easy inflation and deflation of the inflatable pillow. An additional advantage of the embodiments described herein is that the receptacles may be inverted into a self-containing pouch to facilitate storage and transport of the receptacle.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A multi-purpose receptacle comprising:
- a bottom panel; and
- a sidewall attached to the bottom panel and extending in a longitudinal direction therefrom, the sidewall comprising:
  - an open end opposite the bottom panel;
  - a side panel extending around at least a portion of the bottom panel;
  - an inflatable bladder attached to the side panel, the inflatable bladder including a sealed cavity for containing an amount of gas, the inflatable bladder defining a portion of the sidewall;
  - a plurality of compression straps adapted to compress contents contained within the receptacle; and
  - a cap configured to cover the open end of the sidewall, wherein the cap is detachably attached to the receptacle by the compression straps.

2. The multi-purpose receptacle of claim 1, wherein the sidewall includes an interior surface and an exterior surface, and wherein the inflatable bladder defines at least a portion of the interior surface and the exterior surface.

3. The multi-purpose receptacle of claim 1, wherein the inflatable bladder is irremovably incorporated within the sidewall.

4. The multi-purpose receptacle of claim 1, wherein the inflatable bladder includes a valve providing fluid communication with the sealed cavity of the bladder.

5. The multi-purpose receptacle of claim 4, wherein the bladder includes a free edge accessible from an interior of the receptacle and an exterior of the receptacle, the valve being attached to the free edge of the bladder such that the valve is accessible from the interior of the receptacle and the exterior of the receptacle.

6. The multi-purpose receptacle of claim 1, wherein the bladder includes an interior bladder wall and an exterior bladder wall, the interior and exterior bladder walls attached to one another along a central region of the bladder such that a depressed region is formed in the bladder when the bladder is inflated.

7. The multi-purpose receptacle of claim 1, wherein the bladder includes an interior bladder wall and an exterior bladder wall, the interior bladder wall including a liner comprising at least one of fleece and woven cloth.

8. A multi-purpose receptacle comprising:
- a bottom panel; and
- a sidewall attached to the bottom panel and extending in a longitudinal direction therefrom, the sidewall defining an interior and an exterior of the receptacle, the sidewall comprising:
  - a side panel extending around at least a portion of the bottom panel; and
  - an inflatable bladder attached to the side panel, the inflatable bladder including an interior bladder wall exposed to the interior of the receptacle, and an exterior bladder wall exposed to the exterior of the receptacle, wherein the interior bladder wall and the exterior bladder wall define a sealed cavity therein, and wherein the bladder includes a valve attached to a free edge of the bladder such that the valve is accessible from the interior of the receptacle and the exterior of the receptacle and the valve provides fluid communication with the sealed cavity.

9. The multi-purpose receptacle of claim 8, wherein the inflatable bladder is irremovably incorporated within the sidewall.

10. The multi-purpose receptacle of claim 8, wherein the interior bladder wall includes a liner.

11. A multi-purpose receptacle comprising:

a bottom panel; and a sidewall attached to the bottom panel and extending in a longitudinal direction therefrom, the sidewall having an interior surface and an exterior surface, the sidewall comprising:

an inflatable bladder integrally formed within the sidewall, the inflatable bladder including an interior bladder wall at least partially defining the interior surface of the sidewall, and an exterior bladder wall at least partially defining the exterior surface of the sidewall, wherein the interior bladder wall and the exterior bladder wall define a sealed cavity therein, and wherein the bladder includes a valve attached to a free edge of the bladder such that the valve is accessible from the interior of the receptacle and the exterior of the receptacle and the valve provides fluid communication with the sealed cavity.

* * * * *